United States Patent [19]

Grable

[11] 4,157,525

[45] Jun. 5, 1979

[54] THERMOSTATIC ELECTRICAL SWITCH AND METHOD OF SWITCH ASSEMBLY

[75] Inventor: Jack W. Grable, Dayton, Ohio

[73] Assignee: Emerson Electric Co., Dayton, Ohio

[21] Appl. No.: 882,877

[22] Filed: Mar. 2, 1978

[51] Int. Cl.[2] ..... H01H 37/74

[52] U.S. Cl. ..... 337/343; 337/89; 337/365; 29/622

[58] Field of Search ..... 337/89, 91, 112, 113, 337/343, 347, 348, 365, 367, 368; 29/622, 623

[56] References Cited

U.S. PATENT DOCUMENTS

| | | | |
|---|---|---|---|
| 3,213,246 | 10/1965 | Duval | 337/112 |
| 3,430,177 | 2/1969 | Audette | 337/365 |
| 3,443,259 | 5/1969 | Wehl et al. | 337/89 |
| 3,453,577 | 7/1969 | D'Entremont | 337/89 |
| 3,622,930 | 11/1971 | D'Entremont | 337/89 X |

*Primary Examiner*—George Harris

*Attorney, Agent, or Firm*—Biebel, French & Nauman

[57] ABSTRACT

A thermostatic electrical switch and method of switch assembly are disclosed for a switch which provides an electrically conductive path when the temperature of the switch is below a threshold temperature and which opens the path when the temperature of the switch exceeds the threshold temperature. A conductive base plate has a bimetal thermostatic snap element attached at first end of the snap element to the top of the base plate and making electrical contact therewith. The snap element is generally concave upwardly when its temperature is less than the threshold temperature and snaps to a straightened position when its temperature is above the threshold temperature. An electrical snap contact is mounted on the upper surface of the snap element adjacent a second end of the snap element and is electrically connected to the snap element. A conductive cap covers the snap element and is welded to the base plate around a portion of the periphery of the cap, thereby forming a casing with the base plate. The casing defines a casing cavity, in which is positioned the snap element, and further defines an opening communicating with the casing cavity. An electrically conductive terminal has a connector at a first end and a terminal contact at a second end thereof. A mounting means is positioned in the opening for mounting the terminal, such that the terminal extends through the opening. The terminal contact is in contact with the snap contact when the temperature of the snap element is less than the threshold temperature. An electrical path is thereby provided from the casing to the conductive terminal, via the snap element and the snap contact, until the temperature of the switch exceeds the threshold temperature. When the temperature of the switch exceeds the threshold temperature, the snap element snaps to a straightened position, breaking the conductive path between the terminal contact and the snap contact.

14 Claims, 8 Drawing Figures

THERMOSTATIC ELECTRICAL SWITCH AND METHOD OF SWITCH ASSEMBLY

BACKGROUND OF THE INVENTION

The present invention relates to heat sensitive electrical switching devices and, more particularly, to snap action thermostatic electrical switches of the type which is small enough to be incorporated in an electrical device to protect the device from overheating.

It is desirable to protect electrical devices, such as motors, generators, and transformers, from the effects of overheating. While power supply line circuit breakers provide protection from excessive currents for such electrical devices, circuit breakers do not protect against overheating which may occur during continuous operation of a device at a current level which is not excessive. To provide adequate thermal protection for an electrical device, it is necessary that a thermally responsive protective switching arrangement be placed within the device to monitor the temperature of the device. In order for a thermostatic switch to be positionable within an electrical device, such as in the windings of an electric motor, it is necessary that the thermostatic switch be relatively small in size, but in fabricating such a miniaturized thermostatic switch, accurate positioning of the switch elements is difficult to achieve.

In several switch constructions, such as shown in U.S. Pat. No. 3,213,246, issued Oct. 19, 1965, to Duval, and U.S. Pat. No. 3,453,577, issued July 1, 1969, to D'Entremont, a switch casing is formed from a single piece of metal which is drawn into the desired elongated casing shape. Assembly of the switch elements within the switch casing then must necessarily be accomplished in a series of operations during which it is not possible to see the orientation of the switching elements. Such a "blind" assembly procedure is time consuming and can result in misalignment of switch elements.

Other switch constructions are known in which the casing for the thermostatic switch is formed of two separate pieces of material. U.S. Pat. No. 3,430,177, issued Feb. 25, 1969, to Audette discloses a thermostatic switch having a two-piece casing. The casing components are, however, joined either with a thermosetting adhesive or by crimping. U.S. Pat. No. 3,622,930, issued Nov. 23, 1971, to D'Entremont, discloses a motor protector switch having a two-part casing, which parts are joined in a crimp operation. It will be appreciated that such casing arrangements may not provide an adequately sealed casing and, also, when switch components are mounted on both portions of the casing, assembly of the casing results in a blind orientation of the switch components. Additionally, if components are mounted on both portions of the casing, it may be necessary to keep these casing portions electrically isolated to assure proper switching operations.

It is seen, therefore, that there is a need for a simple, easily assembled thermostatic electrical switch which is small in size and which provides reliable thermal switch actuation.

SUMMARY OF THE INVENTION

A thermostatic electrical switch construction and method of switch assembly are provided for an electrical switch which forms an electrically conductive path in a first switching state when the temperature of the switch is below a threshold temperature and which opens the path in a second switching state when the temperature of the switch is above the threshold temperature. The switch includes a conductive base plate and a bimetal thermostatic snap element which is generally concave upwardly in a first switching position when its temperature is less than the threshold temperature and which snaps to a second straightened switching position when its temperature is above the threshold temperature. The snap element is attached at a first end thereof to the top of the base plate and makes electrical contact with the base plate. An electrical snap contact is mounted on the upper surface of the snap element, adjacent a second end of the snap element opposite the first end, and is electrically connected to the snap element. A conductive cap covers the snap element and is welded to the base plate around a portion of the periphery of the cap. The cap and the base plate form a casing which defines a casing cavity within which is positioned the snap element. The casing further defines an opening communicating with the cavity. An electrically conductive terminal, having a connector at a first end and a terminal contact at a second end thereof, is mounted by a mounting means in the opening in the casing such that the terminal extends through the opening. The orientation of the terminal is such that the terminal contact is in contact with the snap contact when the temperature of the snap element is less than the threshold temperature. An electrical path is thereby provided from the casing to the conductive terminal via the snap element and the snap contact until the temperature of the switch exceeds the threshold temperature, at which time the snap element snaps to a straightened position, breaking the conductive path between the terminal contact and the snap contact.

A second electrical connector is provided on the casing in electrical contact with the casing. The second connector may advantageously be formed as a part of the conductive base plate.

The mounting means comprises a non-conductive mounting which is sized to fit within the cavity in the casing and define a terminal opening through which the terminal extends. The mounting means may further comprise a layer of epoxy material surrounding the terminal, adjacent the opening in the casing, which material provides a seal across the opening. A locating ridge along the side of the terminal mates with a groove in the mounting.

A positioning boss on the upper surface of the base plate may be provided, which boss will abut the mounting and facilitate proper positioning of the mounting means and the terminal in the casing cavity.

Accordingly, it is an object of the present invention to provide a thermostatic switch and a method of assembly of such a switch in which assembly of switch elements is facilitated and proper alignment of elements insured; to provide such a switch and method of assembly facilitating reliable switch operation; and to provide such a switch and method of assembly for a mechanically simple and reliable switch.

Other objects and advantages of the invention will be apparent from the following description, the accompanying drawings and the appended claims.

DETAILED DESCRIPTION OF THE PREFERRED EMBODIMENTS

Figure 1:
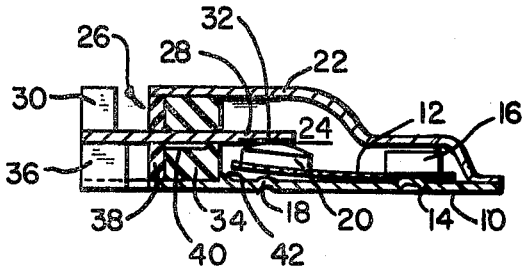
FIG. 1 is a sectional view of the thermostatic electrical switch of the present invention, taken generally along line 1—1 in FIG. 3.
Figure 2:
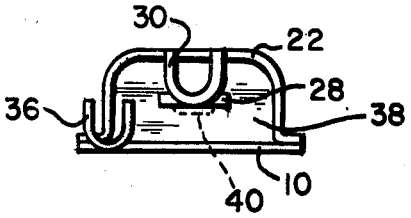
FIG. 2 is a side view of the present invention, as seen looking generally left to right in FIG. 1.
Figure 3:
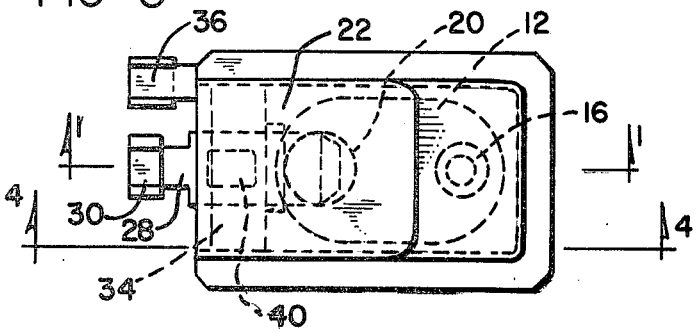
FIG. 3 is a plan view of the switch of FIG. 1.

Reference is now made to FIGS. 1–3 in which the thermostatic electrical switch of the present invention is shown. This switch provides an electrically conductive path when the temperature of the switch is below a threshold temperature and opens this path when the temperature of the switch is above the threshold temperature. A base plate 10, formed of a conductive material, such as cold rolled steel, has a snap element 12 attached to its top surface and electrically contacting the base plate 10. Base plate 10 includes a weld boss 14 which is slightly raised. A weld button 16 is welded to the weld boss 14 through an opening in the snap element 12.

As seen in FIG. 1, the thermostatic snap element 12 is generally concave upwardly in a first switching position when its temperature is less than the threshold temperature. This snap element snaps to a second straightened switching position contact dimple 18 when the temperature of the element is above the threshold temperature. Bimetal snap elements are known in the art which provide rapid snap action at a relatively precise temperature threshold point.

An electrical snap contact 20 is mounted on the upper surface of the snap element 12 adjacent a second end of the snap element and is electrically connected to the snap element 12. A conductive cap 22 covers the snap element 12 and is welded to the base plate 10 on three sides around a portion of the periphery of the cap 22, as seen in FIG. 3. The cap 22 and base plate 10 form a casing which defines a casing cavity 24 in which the snap element 12 is positioned. The casing further defines an opening 26 which communicates with cavity 24.

An electrically conductive terminal 28 has a connector 30 at a first end and a terminal contact 32 at a second end thereof. Terminal 28 may advantageously be formed of yellow brass with the terminal contact 32 comprising a layer of silver which is deposited on the second end of the terminal.

A mounting means, including non-conductive mounting 34, is provided in the opening 26 for mounting terminal 28 such that the terminal 28 extends through the opening 26. The terminal contact 32 is in contact with snap contact 20 when the temperature of the snap element 12 is less than the threshold temperature. An electrical path is thereby provided from the casing to the conductive terminal 28 via the snap element 12 and the snap contact 20 until the temperature of the switch exceeds the threshold temperature, at which time the snap element 12 snaps to a straightened position, breaking the conductive path between the terminal contact 32 and the snap contact 20.

A second electrical connector 36 is provided on the casing for electrical connection thereto. Although the connector 36 is shown as integrally formed as a part of the base plate 10, it should be understood that the connector 36 could be formed on the opposite end of the casing.

The mounting means additionally comprises a layer of epoxy material 38 surrounding the terminal 28 adjacent opening 26 in the casing and providing a seal across the opening. The non-conductive mounting 34 is sized to fit within the cavity 24 and defines a terminal opening through which the terminal 28 extends. The terminal 28 further includes a locating ridge 40 along the bottom side thereof and the terminal opening defines a groove which is sized to receive the locating ridge, thereby providing proper orientation between the terminal 28 and the mounting 34.

A positioning boss 42 is formed on the upper surface of the base plate 10, abutting the mounting 34 and providing proper positioning of the terminal 28 and the mounting 34 with respect to the casing and the snap element 12. As seen in FIG. 1, the mounting 34 will be held securely between the positioning boss 42 and the epoxy material 38.

It should be understood that, although the thermostatic electrical switch illustrated in the drawings provides an electrically conductive path when the temperature of the switch is below the threshold temperature, the present invention also encompasses a thermostatic switch which is open below a threshold temperature and which provides a closed electrically conductive path only when the temperature of the switch exceeds the threshold temperature. Whether the switch is open or closed at temperatures below the threshold temperature is determined by the snap action of the bimetal thermostatic snap element.

Figure 4A:
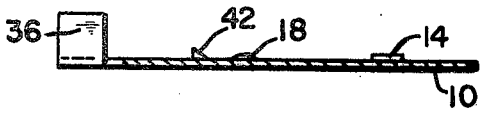
FIGS. 4*a*–4*e* are sectional views taken generally along line 4—4 in FIG. 3, showing the sequence of assembly of the switch of the present invention.
Figure 4D:
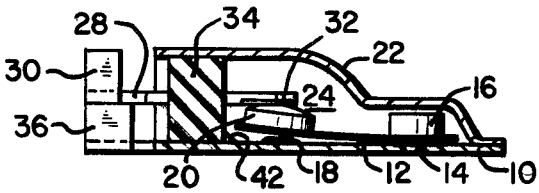
Figure 4B:
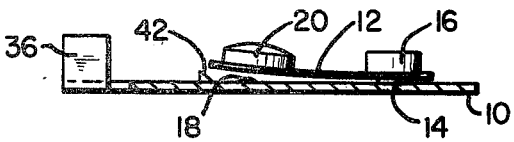

Reference is now made to FIGS. 4*a*–4*e* which illustrate the method of assembly of the thermostatic switch. As shown in FIG. 4*a*, the base plate 10 is formed into the desired shape, typically by a stamping operation using a punch press. The bimetal snap element 12 is then welded to the top of the base plate 10 at a first end of the snap element 12, as shown in FIG. 4*b*. As mentioned previously, the weld button 16 will have a portion sized to fit through the snap element 12 and contact weld boss 14. The welding operation will therefore provide firm attachment of one end of the snap element 12 to the base plate 10 and, additionally, provide the necessary electrical connection between the snap element 12 and the base plate 10.

Figure 4E:
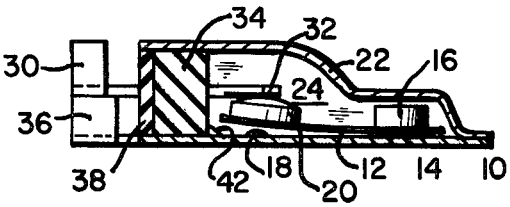
Figure 4C:
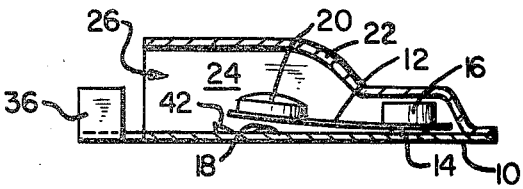

Conductive cap 22 is stamped from a cold rolled steel material into the desired cap shape. Cap 22 is then welded onto the base plate 10 around a portion of the periphery of the cap, as shown in FIG. 4*c*, such that the cap 22 and the base plate 10 form a casing defining a casing cavity 24 and an opening 26 communicating with the cavity 24. Since the snap element 12 is welded to the base plate 10, which ultimately forms a part of the casing, prior to completion of the casing, by welding cap 22 to the base plate 10, attachment of the snap element 12 to the base plate 10 is not a blind operation and may be performed with relative ease.

Electrically conductive terminal 28 is then inserted through the terminal opening in the non-conductive mounting 34 to form a terminal assembly. As shown in FIG. 1, the terminal 28 includes a locating ridge 40 which insures that the terminal 28 is properly positioned with respect to the mounting 34, since this ridge 40 interfits with a corresponding groove in the terminal opening in the mounting 34.

The terminal assembly is then inserted into the cavity 24 through the opening 26, such that the terminal 28 is in contact with the snap contact 20, as seen in FIG. 4*d*. Although this is essentially a blind operation, the positioning boss 42 on the upper surface of the base plate 10 limits the movement of the terminal assembly into the cavity 24 and thereby insures accurate positioning of the terminal assembly. The switch is completed by sealing the opening 26 with an epoxy material, as shown in FIG. 4*e*, thus holding the terminal assembly in its proper place in the cavity 24 and, at the same time, sealing cavity 24 to prevent intrusion of moisture or foreign matter.

While the apparatus herein described and the method of making this apparatus, constitute preferred embodiments of the invention, it is to be understood that the invention is not limited to this precise apparatus and method, and that changes may be made in either without departing from the scope of the invention.

What is claimed is:

1. A thermostatic electrical switch for providing an electrically conductive path when the temperature of the switch is below a threshold temperature and for opening said path when the temperature of the switch is above said threshold temperature, comprising:

a conductive base plate, a bimetal thermostatic snap element which is generally concave upwardly when its temperature is less than said threshold temperature and which snaps to a straightened position when its temperature is above said threshold temperature, said snap element attached at a first end thereof to the top of said base plate and making electrical contact with said base plate, an electrical snap contact mounted on the upper surface of said snap element adjacent a second end of said snap element, opposite said first end, and electrically connected to said snap element, a conductive cap covering said snap element and welded to said base plate around a portion of the periphery of said cap, thereby forming a casing with said base plate, said casing defining a casing cavity in which is positioned said snap element and further defining an opening communicating with said cavity, an electrically conductive terminal having a connector at a first end and a terminal contact at a second end thereof, and mounting means in said opening for mounting said terminal such that said terminal extends through said opening with said terminal contact in contact with said snap contact when the temperature of said snap element is less than said threshold temperature, whereby an electrical path is provided from said casing to said conductive terminal via said snap element and said snap contact until the temperature of said switch exceeds said threshold temperature, at which time said snap element snaps to a straightened position, breaking the conductive path between said terminal contact and said snap contact.

2. The thermostatic switch of claim 1 in which a second electrical connector is provided on said casing and in which said electrically conductive path includes said second electrical connector, said casing, said snap element, said snap contact, and said electrically conductive terminal.

3. The thermostatic switch of claim 2 in which said second connector is provided on said conductive base plate.

4. The thermostatic switch of claim 1 in which said mounting means comprises a non-conductive mounting sized to fit within said cavity in said casing and defining a terminal opening through which said terminal extends, and a layer of epoxy material surrounding said terminal adjacent said opening in said casing and providing a seal thereacross.

5. The thermostatic switch of claim 4 in which said terminal includes a locating ridge provided along a side thereof and in which said terminal opening in said mounting defines a groove for receiving said locating ridge.

6. The thermostatic electrical switch of claim 4 further comprising a positioning boss on the upper surface of said base plate abutting said mounting and providing proper positioning of said mounting means and said terminal in said cavity.

7. The thermostatic switch of claim 1 in which said terminal is formed of yellow brass and in which said terminal contact on said electrically conductive terminal comprises a layer of silver deposited on said second end of said terminal.

8. A method of assembling an electrical thermostatic switch, comprising the steps of:

forming a substantially flat base plate, attaching a bimetal snap element to the top of said base plate at a first end of said snap element such that said snap element is in electrical contact with said base plate, said snap element having a snap contact mounted on the upper surface of said snap element adjacent a second end of said snap element, forming a conductive cap, welding said cap to said base plate around a portion of the periphery of said cap to form a casing with said base plate, said casing defining a casing cavity in which is positioned said snap element, and further defining an opening communicating with said cavity, inserting an electrically conductive terminal through a terminal opening in a non-conductive mounting to form a terminal assembly, said terminal having a connector at a first end on one side of said mounting and a terminal contact at a second end thereof on the other side of said mounting, inserting said terminal assembly into said cavity through said opening communicating with said cavity such that said terminal assembly is properly positioned, and sealing said opening communicating with said cavity with an epoxy material such that said terminal assembly is held in said cavity.

9. The method of assembling a thermostatic switch of claim 8 in which said step of inserting said terminal assembly into said cavity such that said terminal assembly is properly positioned includes the steps of positioning said terminal contact in contact with said snap element.

10. The method of assembling a thermostatic switch of claim 9 in which said step of forming a substantially flat base plate includes the step of forming a positioning boss across the upper surface of said base plate and further in which said terminal assembly is inserted into said cavity abutting said positioning boss, whereby said terminal assembly is held between said positioning boss and said epoxy material sealing said opening such that said terminal contact is accurately positioned to contact said snap contact.

11. The method of assembling a thermostatic switch of claim 8 in which said step of attaching said bimetal snap element to the top of said base plate includes the step of welding said snap element to said base plate.

12. A thermostatic electrical switch which assumes a first switching state when the temperature of the switch is below a threshold temperature and which assumes a second switching state when the temperature of the switch is above said threshold temperature, comprising:

a conductive base plate, a bimetal thermostatic snap element which assumes a first switching position when its temperature is less than said threshold temperature and which snaps to a second switching position when its temperature is above said threshold temperature, said snap element attached at a first end thereof to the top of said base plate and making electrical contact with said base plate, an electrical snap contact mounted on the upper surface of said snap element adjacent a second end of said snap element, opposite said first end, and electrically connected to said snap element, a conductive cap covering said snap element and welded to said base plate around a portion of the periphery of said cap, thereby forming a casing with said base plate, said casing defining a casing cavity in which is positioned said snap element and further defining an opening communicating with said cavity, an electrically conductive terminal having a connector at a first end and a terminal contact at a second end thereof, and mounting means in said opening for mounting said terminal such that said terminal extends through said opening with said terminal contact in contact with said snap contact when said snap element is in one of said first and second switching positions and said terminal contact is out of contact with said snap contact when said snap element is in the other of said first and second switching positions, whereby an electrical path from said casing to said conductive terminal via said snap element and said snap contact is provided when said switch is in one of said first and second switching states, and said electrical path is broken when said switch is in the other of said first and second switching states.

13. The thermostatic switch of claim 12 in which said electrical path is provided when said switch assumes said first switching state and in which said electrical path is broken when said switch assumes said second switching state.

14. The thermostatic switch of claim 12 in which said base plate includes a positioning boss on the upper surface of said base plate abutting said mounting means and providing proper positioning of said mounting means and said terminal in said cavity.

* * * * *